United States Patent [19]

Porsfeld

[11] Patent Number: 4,890,680

[45] Date of Patent: Jan. 2, 1990

[54] MACHINE FOR WORKING ROCK, ESPECIALLY A BLOCK DRILLING MACHINE

[76] Inventor: Friedhelm Porsfeld, Passau, Fed. Rep. of Germany

[21] Appl. No.: 139,455

[22] Filed: Dec. 30, 1987

[51] Int. Cl.[4] ..... E21B 15/04

[52] U.S. Cl. ..... 173/42; 173/22; 173/39

[58] Field of Search ..... 173/22, 39, 42, 43, 173/163; 175/202; 172/76

[56] References Cited

U.S. PATENT DOCUMENTS 4,288,056 9/1981 Bergstrom ..... 173/43
4,499,953 2/1985 Molin ..... 173/43

FOREIGN PATENT DOCUMENTS 1132530 9/1982 Canada ..... 173/43
2189724 11/1987 United Kingdom ..... 173/43

*Primary Examiner*—Douglas D. Watts
*Assistant Examiner*—W. Fridie
*Attorney, Agent, or Firm*—Lorusso & Loud

[57] ABSTRACT

A machine for working rock, especially a block drilling machine, comprising at least one working tool, especially drilling tool. The drilling unit comprising the drilling tool is adapted to be connected to a supporting means in such a way that it has three degrees of freedom of rotation relative to the supporting means, which means it is movable, i.e. rotatable, relative to the supporting means about three axes which are respectively normal to each other. Furthermore the supporting means itself has at least two degrees of freedom of rotation relative to the ground. In particular, the supporting means can be pivoted about an axis which is approximately normal to the ground and an axis which is approximately parallel thereto, respectively.

24 Claims, 10 Drawing Sheets

MACHINE FOR WORKING ROCK, ESPECIALLY A BLOCK DRILLING MACHINE

The present invention is directed to a machine for working rock, especially a block drilling machine, comprising at least one working tool, especially a drilling tool, preferably a rock drilling hammer.

Presently, quarries are worked in blocks by holes being drilled into the rock in spaced relationship along a predetermined line, which is done manually with the help of air drilling hammers which correspond in size approximately to an air hammer for civil engineering works. Feathers are then inserted into the drilled holes and spreading is performed by hydraulic means. Thereby the rock is "cracked off" along the predetermined line of holes.

It is obvious that such work is extremely laborious and connected with much noise and dust as well as being inaccurate. In bad weather conditions, especially in winter, nobody can be expected to carry out such work, and moreover it would also be dangerous. This is why no quarrying is ever done in winter. When the holes are deeper than 1 m, exact guiding of the rock drilling hammer can no longer be ensured. It is unavoidable that at greater depths of up to 1 m the holes will run untrue and partly even intersect. This danger is particularly great in case of varying rock sheets. Since the crude block must be free from damage, untrue holes result in considerable losses of material, which at present amount up to 30%.

In the process described above it is also highly problematic to discharge the drillings. Above all, care must always be taken for the drillings not to reach an adjacent hole, because this would be a considerable obstacle to the insertion of the feathers.

In spite of protective measures such as ear muffs, auditory damage cannot be avoided because of the extreme proximity between quarry man and drilling hammer. It is therefore not surprising that many quarry men are nearly deaf, all the more as many of them fail to put on ear muffs.

Finally, the permanent mechanical vibrations which are transferred from the drilling hammer to the quarry man's body result in considerable injuries to health.

The present invention is therefore based on the object of providing a machine of the above-specified kind with which blockwise quarrying is possible efficiently and with minimum loss of material both in summer and winter while special consideration is given to the quarry men's health.

This object is solved by the characterizing features of patent claim 1 and, as regards structural details, in accordance with the subclaims.

The design according to the invention does away with the close proximity between rock drilling tool, especially drilling hammer, and quarry man without detrimentally affecting the mobility of the drilling tool in respect of positioning thereof. In this respect the invention is a kind of "robot construction". By the spatial separation between rock drilling tool and quarry man it is possible to achieve a considerable reduction in the above-mentioned effects that are injurious to health. Also, drilling is possible with far greater precision, if required down to a hole depth of 10 m. In manual drilling, hole depths of down to a maximum of 2 m could be controlled. The large hole depths can be controlled especially when the supporting means for the drilling tool is constituted by the boom of an excavator, especially a power shovel, as specified in claim 2. The excavator mass can be fully utilized for stabilizing the drilling tool, and with the measures specified in claim 9 a controlled "mass application" is possible, which depends on the drilling resistance. In this way it is also ensured that the drilling tool will not suddenly "fall through" when it penetrates a deeper, soft rock sheet such as a sheet of clay.

Due to the fact that the support means is part of an excavator, additional degrees of freedom of rotation are provided, i.e. the mobility of the rock drilling tool relative to its position is additionally improved. This applies especially for the measures specified in claims 3 and 4. Also, mobility is ensured by the excavator. The drilling work can be controlled from the excavator cabin, i.e. from a noise-reducing environment which is additionally protected against dust or the like. Furthermore, work can be done from the excavator cabin very conveniently even in winter.

Finally, the measures specified in claims 6 and 7 are of considerable significance. It is thereby possible to position and move the drilling tool or tools with extreme precision and to determine the hole depth down to a millimeter.

The suction skirt specified in claim 10 and the following claims is of further significance to the discharge of drillings and dust and the reduction of noise, and the structural details of claim 11 offer the possibility of effecting a rapid change of drill rods without having to move the machine. Also, it is thereby possible in case of a drilling tool being jammed in the rock to remove the drilling tool from the drilling hammer and to move the drilling hammer to the next position while another tool is fitted. To this end it is merely necessary to open the suction skirt to expose the jammed drilling tool and to move with the drilling hammer to the next position. When a fresh drilling tool has been fitted to the drilling hammer, the suction skirt will be closed again and the drilling work may continue.

Claims 13 and 14 describe features which provide for safe handling in the vicinity of the suction skirt, which can be opened and closed.

Finally, the measures specified in claim 17 are of special importance for practical operation. By means of the ultrasonic generator associated with the suction skirt it is ensured that the latter always remains free for the discharge of drillings and dust even if moist material is concerned which normally has a tendency to stick to the inside of the suction skirt and to block the skirt after no more than a few hours. Conditions are similar in the vicinity of the impact-type separator provided in accordance with the invention.

The measures specified in claim 18 and the following claims are suited for additional noise reduction. These measures are especially provided to reduce the noise in the neighbourhood of the working site.

The drilling output can be considerably improved by the measures specified in claim 24.

Below, a preferred embodiment of the machine according to the present invention will be described in detail with reference to the accompanying drawing, in which.

Figure 9:
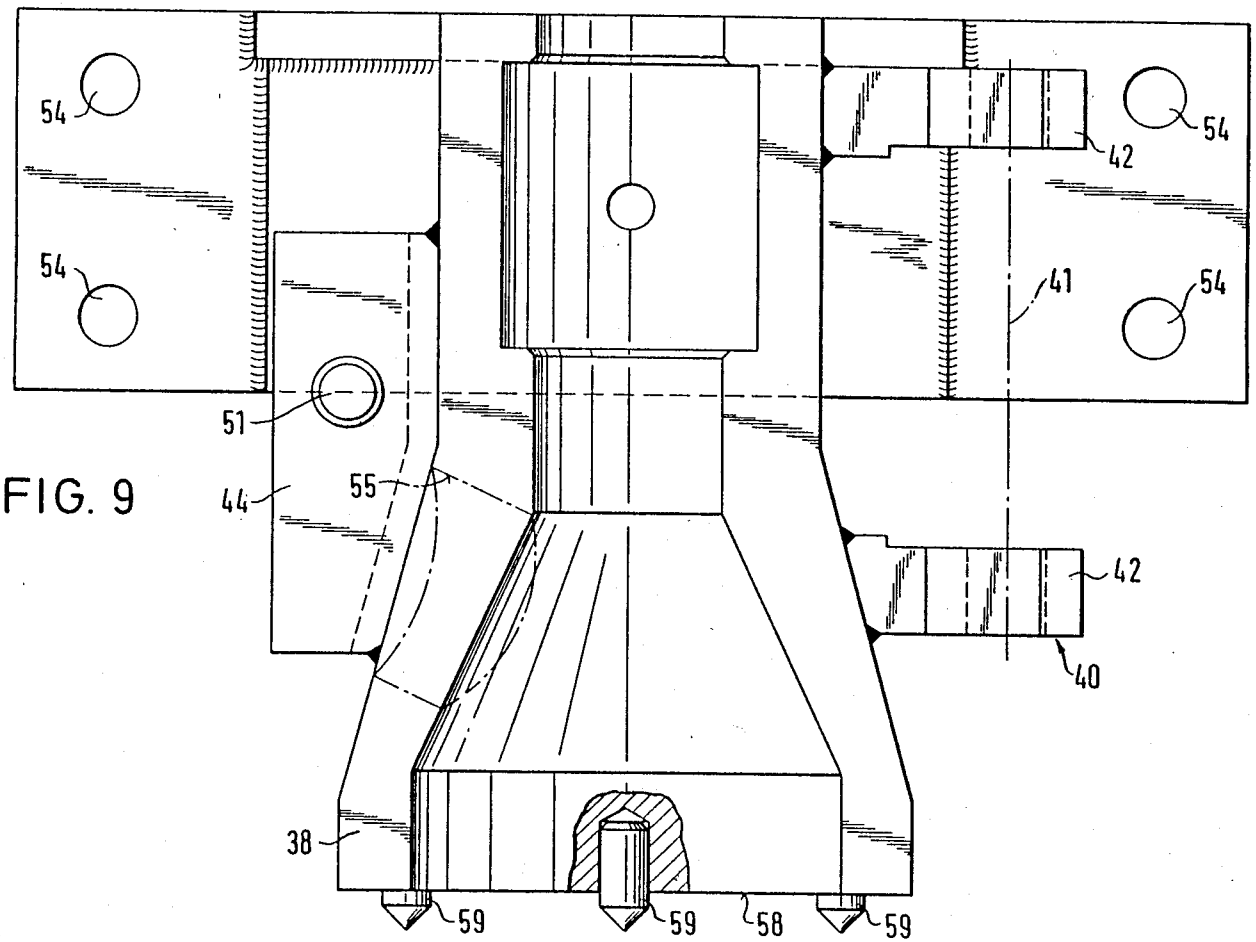
FIGS. 9 and 10 are a side view and a partially sectioned plan view, respectively, of that half of the suction skirt provided by the invention which is fixed to the cradle of the machine according to the invention.
Figure 10:
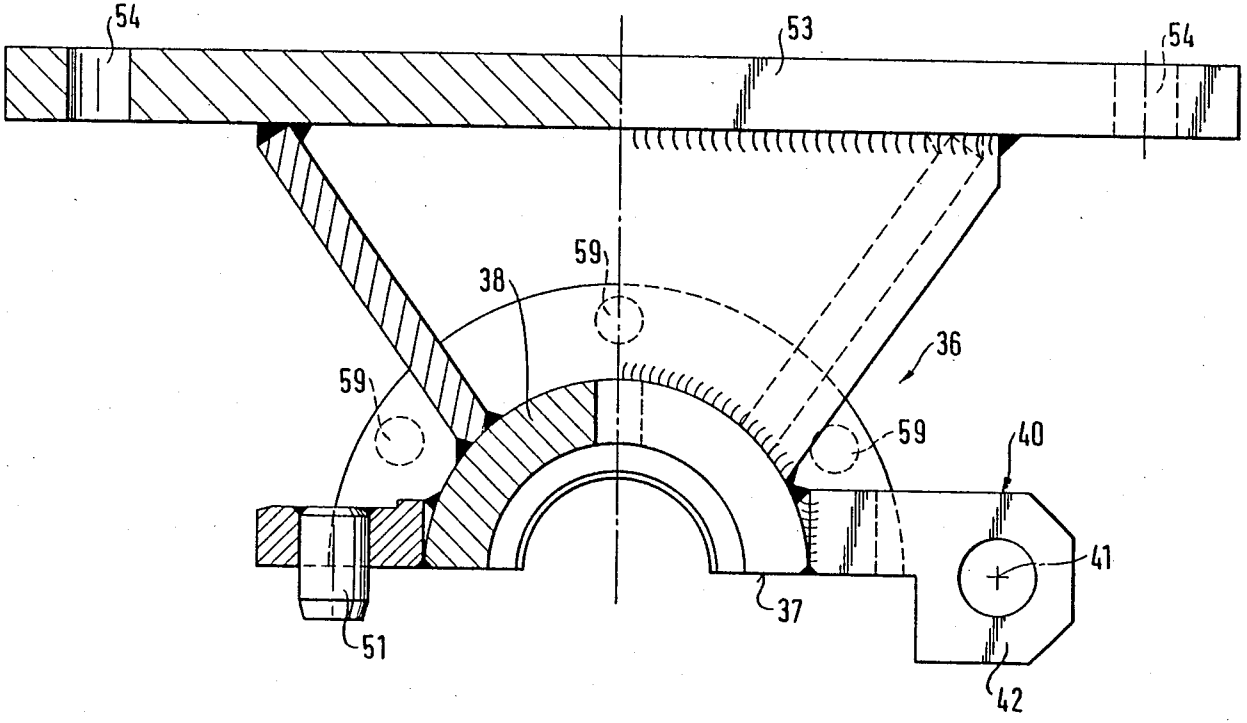
Figure 11:
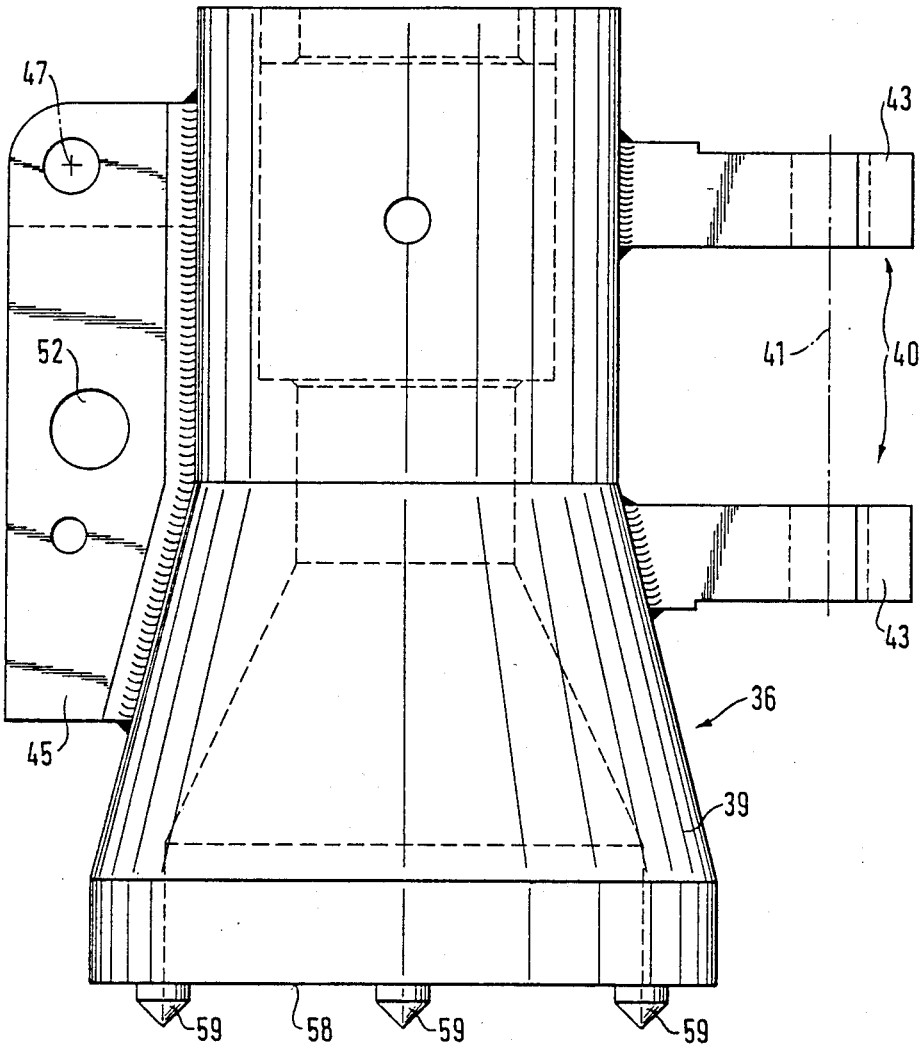
Figure 12:
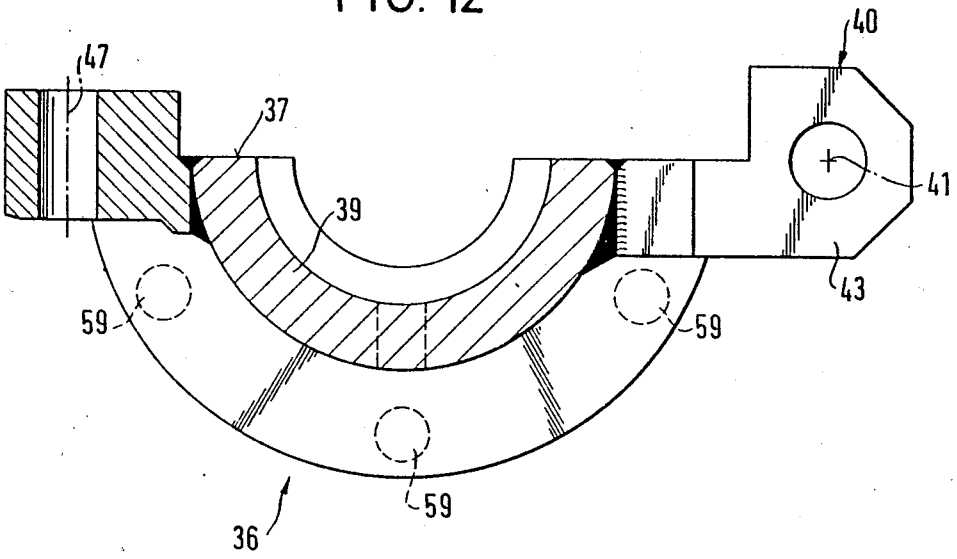
Figure 14:
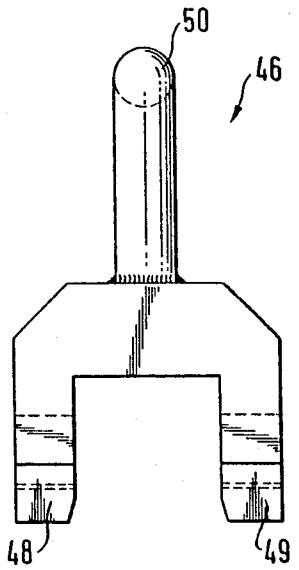
Figure 13:
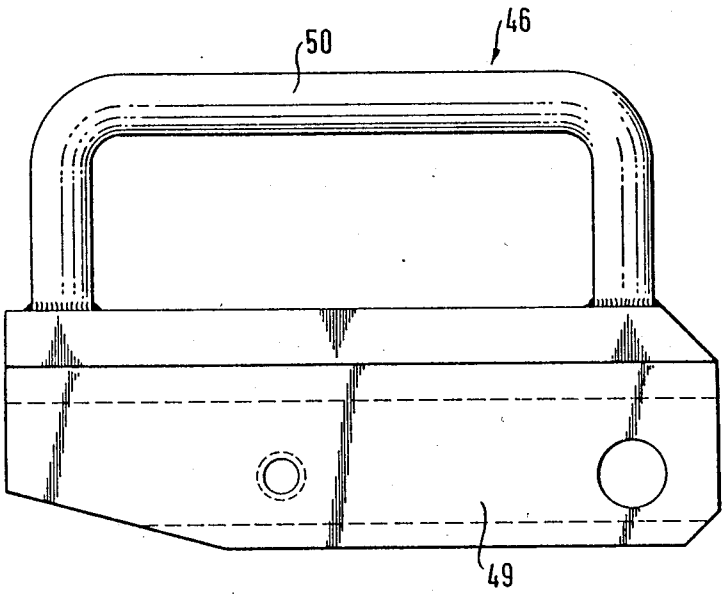

FIGS. 11 and 12 are likewise a side view and a partially sectional plan view, respectively, of the suction skirt half which is pivotally connected to the suction skirt half shown in FIGS. 9 and 10; and FIGS. 13 and 14 are a side view and a plan view, respectively, of a locking strap cooperating with the two suction skirt halves.

The arrangement schematically illustrated in FIGS. 1 to 7 for rock working, i.e. for blockwise quarrying, comprises a conventional power shovel 1 to the boom 2 of which a drilling unit 3 is fitted. Power shovel, boom and drilling assembly together constitute a self-contained block drilling machine, in which the boom 2 of the power shovel 1 functions as support means for the drilling unit 3 or, respectively, the associated drilling tool, viz. a drill rod 4. Relative to the boom 2 the drilling unit 3 and thus the drilling tool 4 is fitted in such a way that it has three degrees of freedom of rotation, i.e. it is movable or pivotable relative to the boom 2 about three axes $x_{1,3}$, y and $z_1$ which are respectively normal to each other. The boom 2 has two degress of freedom of rotation relative to the ground 5, the one degree of freedom of rotation being defined by the horizontal pivot axis $x_2$ of the boom 2 on the structure, viz., the power and operator's cabin 6 of the power shovel, while the other degree of freedom of rotation is defined by the vertical pivot axis $z_2$ of the power and operator's cabin 6 relative to the chassis 7 of the power shovel.

More in detail, the free end of the boom 2 has a connecting member for the drilling unit 3 configured as a connecting plate 8 pivotally mounted thereon, the pivot axis $x_3$ extending in parallel to the pivot axis $x_2$ of the boom 2 on the power and operator's cabin 6 of the power shovel. The connecting plate 8 is retained for pivoting movement about the axis $x_3$ by an hydraulic piston-cylinder unit 9 linked at one end to the connecting plate 8 and at the other end to the boom 2. As is known per se, the boom 2 comprises two pivotally connected boom arms 10, 11, the connecting pivot axis $x_4$ extending in parallel to the pivot axis $x_2$ of the boom 2 on the power shovel cabin 6. The swinging motion of the outer boom arm 11 relative to the boom arm 10 connected to the cabin 6 about the axis $x_4$ is likewise caused by an hydraulically controlled piston-cylinder unit 12, which is linked at one end to the outer boom arm 11 and at the other end to the inner boom arm 10 linked to the cabin 6 (coupling points 13, 14). The boom 2 is supported by an hydraulically controlled piston-cylinder unit 15, which is coupled at one end to the shovel structure or the power and operator's cabin 6 and at the other end to the inner boom arm 10. The coupling point at the inner boom arm 10 is referenced 16 in FIG. 1.

Figure 1:
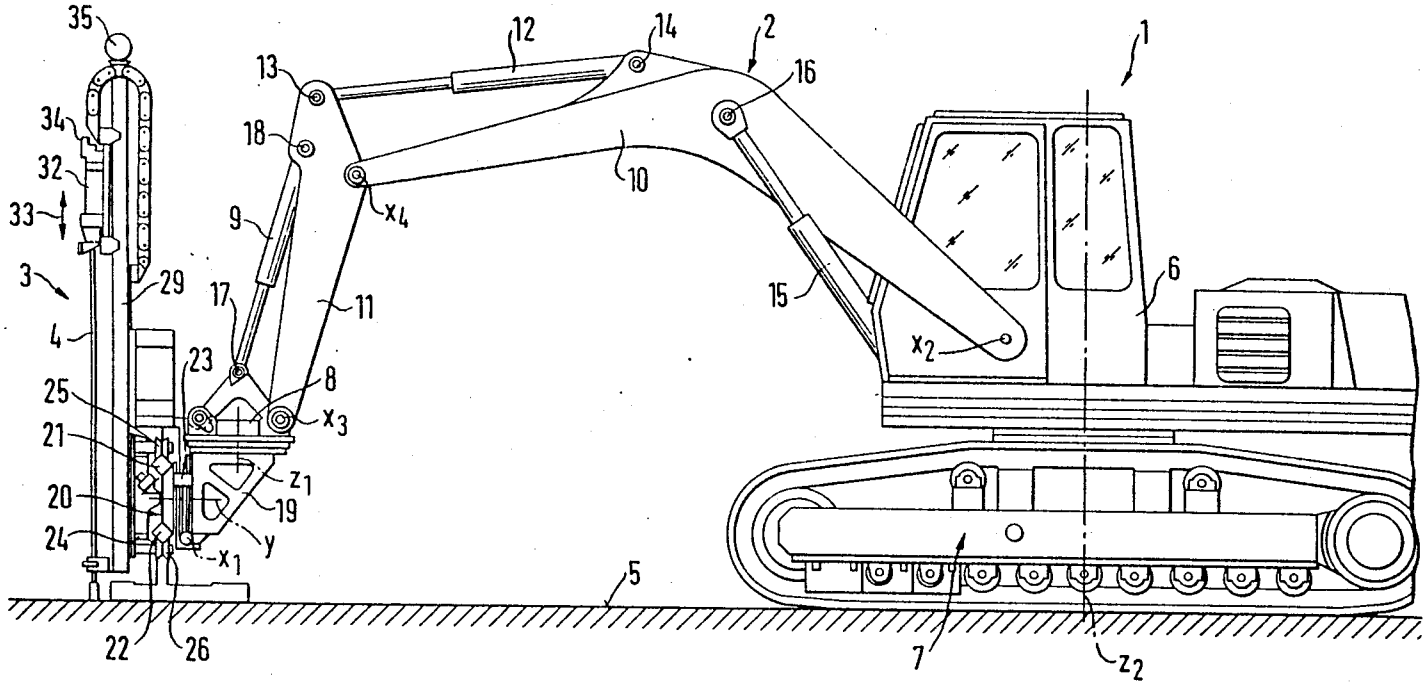
FIG. 1 is a side view of a machine according to the invention fitted to a power shovel.

The coupling points of the above-mentioned piston-cylinder unit 9 at the connecting plate 8, on the one hand, and the outer boom arm 11, on the other hand, are referenced 17 and 18 in FIG. 1.

The drilling unit 3 is fitted to the connecting plate 8 via a triangular frame-type connecting bracket 19, the connection between bracket 19 and connecting plate 8 being configured as a pivot bearing whose geometrical axis of rotation $z_1$ is normal to the plane of the connecting plate. In FIG. 1 the axis of rotation $z_1$ is normal to the ground 5, i.e. it extends in parallel to the pivot axis $x_2$ of the power and operator's cab 6 relative to the chassis 7 of the excavator. Rotation of the connecting bracket 19 relative to the connecting plate 8 about the axis $z_1$ is effected by means of a specially associated (not illustrated) drive motor, especially an hydraulic motor, through a range of 360°.

The drilling unit 3 comprises a framework-like crossmember 20 having an upper and a lower crossbeam 21 and 22 each designed as a runner. This crossmember 20 with a length of about 3 to 4 m (see also FIG. 6) is pivotally mounted on the connecting bracket 19, wherein the pivot axis $x_1$ extending in parallel to the longitudinal extension of the crossmember 20 is in the lower region of the crossmember 20 or approximately at the level of the lower crossbeam 22, respectively. For the rest, the crossmember 20 is retained on the connecting bracket 19 by a piston-cylinder unit 23 which is preferably also hydraulically controlled and is disposed above the pivot axis $x_1$. By means of this pistoncylinder unit 23 the drilling unit 3 or, respectively, the crossmember 20 thereof can be swivelled relative to the connecting bracket 19 about the pivot axis $x_1$, the swivelling range in accordance with FIG. 7 being ±7°, i.e. a total of about 14°. Of course, with appropriate dimensioning this swivelling range can be varied. This depends not least on external conditions to which the drilling rig must be adapted.

The crossbeams 21, 22 support a carriage 24 which reciprocates along the same, the supporting rollers being referenced 25, 26 in FIG. 1.

Figure 6:
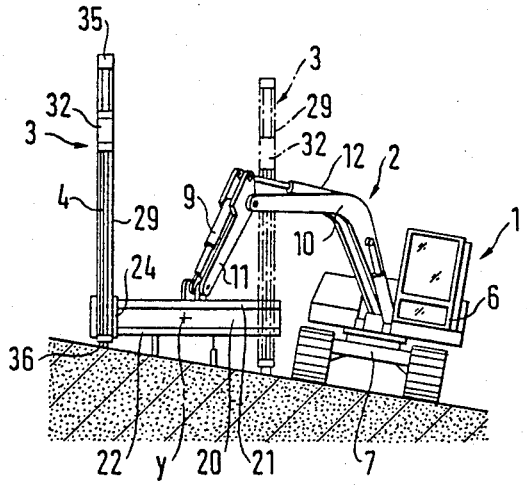
Figure 7:
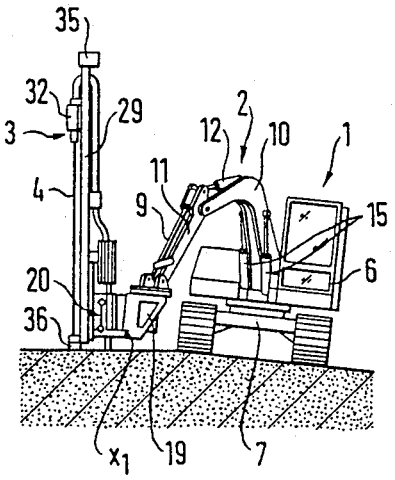

It should be noted that the crossmember 20 or the drilling unit 3, respectively, is rotatable relative to the connecting bracket 19, wherein the axis of rotation y is normal to the axis of rotation $z_1$. To this end the connecting bracket 19 has a crossmember connecting plate 27 pivoted thereto according to FIG. 8, whereby the abovementioned pivot axis $x_2$ is defined. Connection of the crossmember 20 to said connecting plate 27 is effected through a rotary bearing indicated at 28 in FIG. 8. This rotary bearing 28 defines the afore-mentioned axis of rotation y. The turning range of the crossmember 20 about the axis y extends through 360°. To this end the crossmember 20 has a separate rotary drive means associated therewith which is preferably an hydraulic motor (not illustrated in the drawing). FIG. 6 illustrates the advantages offered by the degree of freedom of rotation defined by the rotary axis y when work is performed along a slope. The advantage offered by the degree of freedom of rotation defined by the pivot axis $x_1$ is illustrated in FIG. 7, when the power shovel rests at an inclination relative to the drilled rock surface.

The carriage 24, which is reciprocatingly movable along the crossmember 20, has a cradle 29 mounted thereon in such a way as to extend approximately perpendicularly to the crossmember 20. Thus the cradle 29 is reciprocatingly movable together with the carriage 24 along the crossmember 20. Furthermore, the cradle 29 is mounted on the carriage 24 so as to be longitudinally movable, such longitudinal movement being caused by a piston-cylinder unit 39 (see FIG. 8). The travelling distance is preferably between about 60 cm and 120 cm. The linear bearing between cradle 29 and carriage 24 is indicated at 31 in FIG. 8. On the side of the cradle 29 remote from the crossmember 20 the drilling unit 3, i.e. a drilling hammer 32 including the drill rod 4 is mounted for reciprocating movement in longitudinal direction of the cradle 29 (double arrow 33).

For reciprocating the drilling hammer 32 including the drill rod 4 along the cradle 29. i.e. in the direction of the double arrow 33, the drilling hammer 32 or, respectively, the slide 34 associated therewith is joined to a chain revolving at both ends of the cradle 29, said chain cooperating with a pinion of a drive motor (hydraulic motor 35). Thus, the rock drilling hammer 32 together with the drill rod 4 is pulled either upwards or downwards by means of the revolving chain. The mentioned pinion also has a slotted disk (not illustrated) associated therewith which in cooperation with an optical or electromagnetic sensor permits the motion of the pinion and thus the motion of the drilling unit 3 along the cradle 29 to be digitalized. For each passage of a slot of the slotted disk past the sensor a counting pulse will be generated. Thereby the angle steps are counted upwardly and downwardly. In this way a very accurate distance measurement is possible and the drilling depth can be respectively preset or determined accurately.

Similar conditions prevail in respect of the drive means for the carriage 24. The carriage is likewise joined to a chain revolving about both ends of the crossmember 20, said chain cooperating with a pinion of a drive motor (not illustrated), wherein the pinion likewise has a slotted disk associated therewith which in cooperation with an optical or electromagnetic sensor permits the motions of the pinion and thus of the carriage 24 including the cradle 29 along the crossmember 20 to be digitalized. In this way the cradle or the drilling unit 3, respectively, can be positioned with high accuracy.

Figure 2:
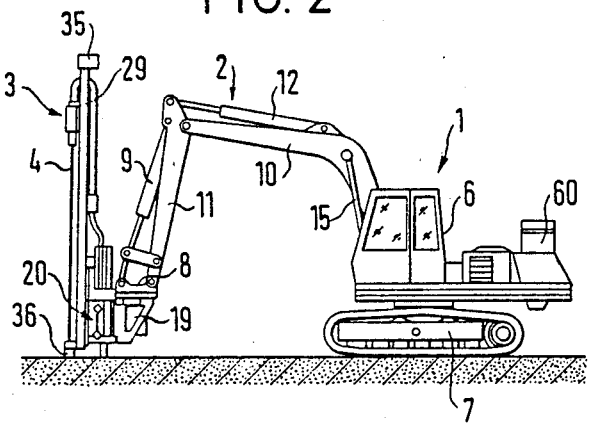
FIGS. 2 to 7 are positional variations of the drilling machine according to the invention, in which the flexibility of the machine is illustrated.
Figure 3:
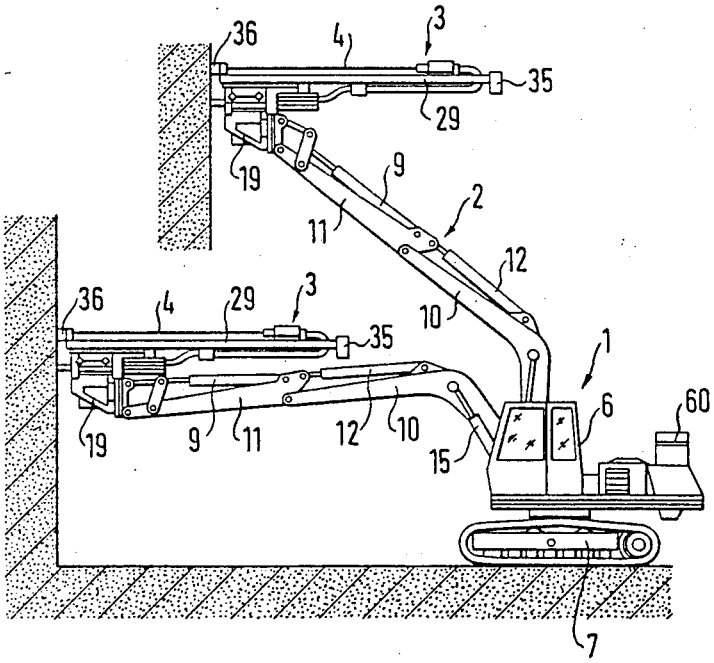
Figure 4:
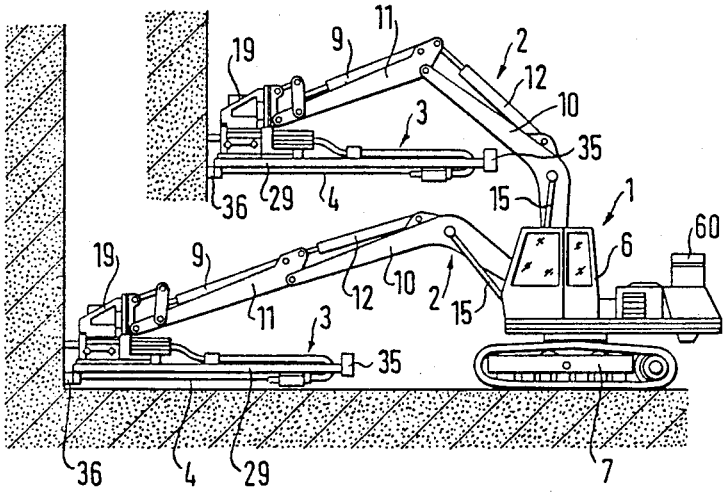
Figure 5:
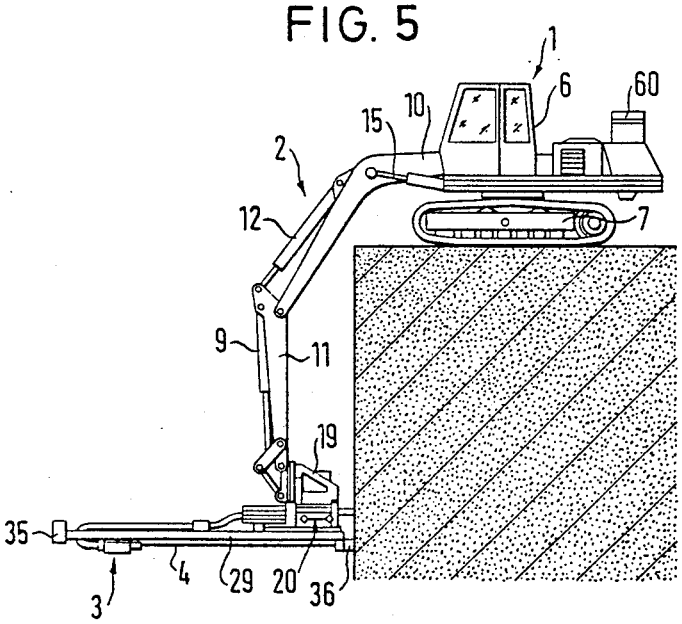

Due to the above-mentioned pivot axes or axes of rotation $x_1$, $x_2$, $x_3$, $x_4$, y, $z_1$ and $z_2$ it is possible to achieve extremely good flexibility and mobility of the machine. This mobility will be especially apparent from FIGS. 2 to 7. FIG. 2 corresponds to FIG. 1. The hole is drilled perpendicularly to the mounting plane of the machine. In FIG. 3 the hole is shown drilled into a perpendicular wall. This also applies to FIG. 4, where the hole is drilled in a bottom corner portion which is normally inaccessible or accessible only with difficulty. FIG. 5 also shows the hole drilled into a vertical wall, viz. a vertical wall extending below the mounting plane of the machine or power shovel 1, respectively. FIG. 6 shows how a perpendicular hole can be drilled on an inclined surface. FIG. 7 shows the hole being drilled on a horizontal surface with the power shovel 1 at an inclination. Of course, FIGS. 2 to 7 do not show every possible variation; but they serve to indicate the wide range of flexibility of the described arrangement very well.

As already explained above, it is important in respect of noise reduction and prevention of fine dust or the like that a suction skirt 36 is provided at the lower end of the cradle 29 which faces the drilled rock (see FIG. 8), said suction skirt having multiple functions:

- supporting the drilling unit including cradle and crossmember on the rock surface, especially with a predetermined compression by means of the piston-cylinder units 9, 12 and/or 15;
- collection of dust;
- noise reduction;
- support for drilling tool or drill rod in such a way that it is disposed extremely close to the ground.

As already indicated above, the suction skirt 36 is designed to be opened, the parting plane extending through the geometrical center axis of the drilling tool, i.e. of the drill rod 4. In FIGS. 10 and 12 the parting plane is indicated at 37. Accordingly, the suction skirt is composed of two halves 38, 39, the one half 38 being fixedly joined to the cradle 29 at the bottom end of the same. The other half 39 is hinged to the first-mentioned half by means of a hinge 40 whose hinge axis 41 extends in parallel to the geometrical center axis of the drill rod 4 or the suction skirt 36, respectively. To form the mentioned hinge, two spaced flanges 42 are provided, especially welded to the suction skirt half 38 fixed on the cradle, said flanges being approximately normal to the axis of the suction skirt. Each flange 42 is formed with a bore and the bores are in alignment and define the hinge axis 41. In a similar way, the other suction skirt half 39 is provided with two flanges 43 which are also formed with a through-bore each. The flanges 42, 43 are fitted into each other with their bores in alignment. A hinge pin is then inserted through the bores about which the movable suction skirt half 39 can be turned.

On the side diametrically opposite to the hinge axis 41, a flange 44, 45 is respectively welded to the two suction skirt halves such that the flanges extend approximately in parallel to the parting plane 37. In the closed position of the suction skirt 36 the facing inner sides of the flanges 44, 45 are contiguous. For locking this position a safety locking strap 46 is provided which is shown in FIGS. 13 and 14. The locking strap is pivoted with one end thereof to one of the two flanges, which in the illustrated embodiment is the flange 45 of the movable suction skirt half 39, such that the center of gravity of the locking strap 46 is below the pivot 47 on the flange 45. It is thereby ensured that the locking strap 46 will always automatically drop into the locking position. The safety moment is correspondingly high. As shown in FIG. 14, the locking strap 46 has U-shaped cross-section. In the closed position of the suction skirt the two flanges 44, 45 are held between the two legs 48, 49 of the U-shaped locking strap 46. To fix the locking strap 46 in the locking position a cotter pin is preferably provided which can be fitted through holes that register in the locking position and are formed in the two legs 48, 49 of the locking strap and in the two flanges 44, 45, which extend in parallel to the parting plane 37. As shown in FIGS. 13 and 14, the locking strap also has a U-shaped handle 50 by means of which it can readily be moved to and retained in its open position.

In order to align the two suction skirt halves 38, 39 in the closed position while forming a precise radial bearing for the drill rod 4 extending through the suction skirt 36, an alignment pin 51 is provided which is normal to the parting plane 37 and which, in the illustrated embodiment, is mounted on the inner side of the flange 44. The portion of the alignment pin 51 which projects beyond the parting plane 37 coincides with a corresponding hole 52 in the flange 45 of the pivotally mounted suction skirt half 39.

Connection of the one suction skirt half 38 to the bottom end of the cradle 29 is through a connecting plate 53 which is rigidly connected to the associated suction skirt half 38. The connecting plate 53 is formed with holes 54 through which correspondingly sized fastening bolts can be passed.

Due to the provided separation of the suction skirt 36 a rapid tool change is possible while the machine need not be moved. Above all, it is not unduly inconvenient to separate the machine from a drilling tool jammed in the rock and to freshly locate the drilling unit 3 after previous fitting of a fresh drilling tool or drill rod 4. The suction skirt 36 is formed with an opening 55 to which a hose 56 extending to a suction means can be fitted, an impact-type separator 57 (see FIG. 8) being preferably provided between the suction means and the suction skirt 36 for separating larger-sized drillings so that substantially nothing but microscopic dust will reach the suction and filter unit.

In order to reliably prevent the suction skirt from becoming covered with dust, especially in case of moist drillings and during work done in winter, the suction skirt cooperates with an ultrasonic generator (not illustrated) by means of which it is possible to properly crack away or filter off any material adhering to the inside of the suction skirt and in the vicinity of the hose fitting. Preferably, the impact-type separator 57 also cooperates with such an ultrasonic generator.

Another way of preventing the deposition of moist dust would be to heat the suction skirt to a high degree so that moist dust would be dried within the free space of the suction skirt 36. Such dried dust would show a far lesser tendency to sticking to the suction skirt inside so that the latter could be used for a correspondingly extended period of time.

The end face 58 of the suction skirt 36 presented to the ground cooperates also with supporting pins 59 projecting beyond the end face. Thereby a certain spacing is ensured between the ground-side end face 58 of the suction skirt 36 and the ground or surface of the drilled rock. In this way an annular gap is formed between the suction skirt 36 and the surface of the drilled rock or ground, through which gap ambient air may be sucked into the interior of the suction skirt 36.

For even better noise reduction the suction skirt 36 may be connected to a jacket which extends from the suction skirt to the casing of the drilling hammer and optionally also encloses said casing, wherein said jacket consists of a sound-insulating and sound-absorbing material, which is preferably flexible, so that the relative movement between drilling hammer 32 and suction skirt 36 is not impeded thereby.

Also, for improved sound dissipation the suction skirt 36 may be formed at defined locations with openings for the further entry of air. Preferably, the openings are formed diametrically to the center axis of the suction skirt 36, especially in opposed relationship. Moreover, they are dimensioned such that together with the volume of air contained in the suction skirt 36 they constitute so-called Helmholtz resonators.

Finally, the mentioned openings can be provided at such an inclination in the same direction relative to the center axis of the suction skirt 36 that a helical flow of air will result within the suction skirt 36. Thereby a certain degree of pre-drying of the dust inside the suction skirt is achieved, whereby deposits are additionally prevented.

Tests have also shown that it is advantageous for sound insulation when the suction skirt has circumferentially distributed concavities in the vicinity of which the additional air intake openings are provided.

By proper control of the piston-cylinder units 9, 12 and/or 15 it is possible always to keep the suction skirt 36 in engagement with the surface of the drilled rock even though the drilling resistance might vary greatly.

In respect of the hydraulic system it should also be noted that an hydraulic motor is provided for the rotary motion of the drilling tool, i.e. the drill rod 4. The continuous rotary motion produced by the hydraulic motor can additionally have an oscillatory motion superposed thereon, which is done by means of an hydraulic pulsator cooperating with the hydraulic motor. This results in a kind of vibrating rotary motion of the drilling tool. Preferably, a pulsating motion within the resonant range of the drilled rock is impressed upon the rotary motion of the drill rod 4. In this way the drilling output can be considerably increased.

Finally, it should be noted that in the illustrated embodiment only one cradle 29 is provided. But it would also be conceivable to mount on the crossmember 20 two or three cradles with corresponding drilling units in such a way that these would be reciprocable along the crossmember 20 either jointly or individually or independently of each other.

Figure 8:
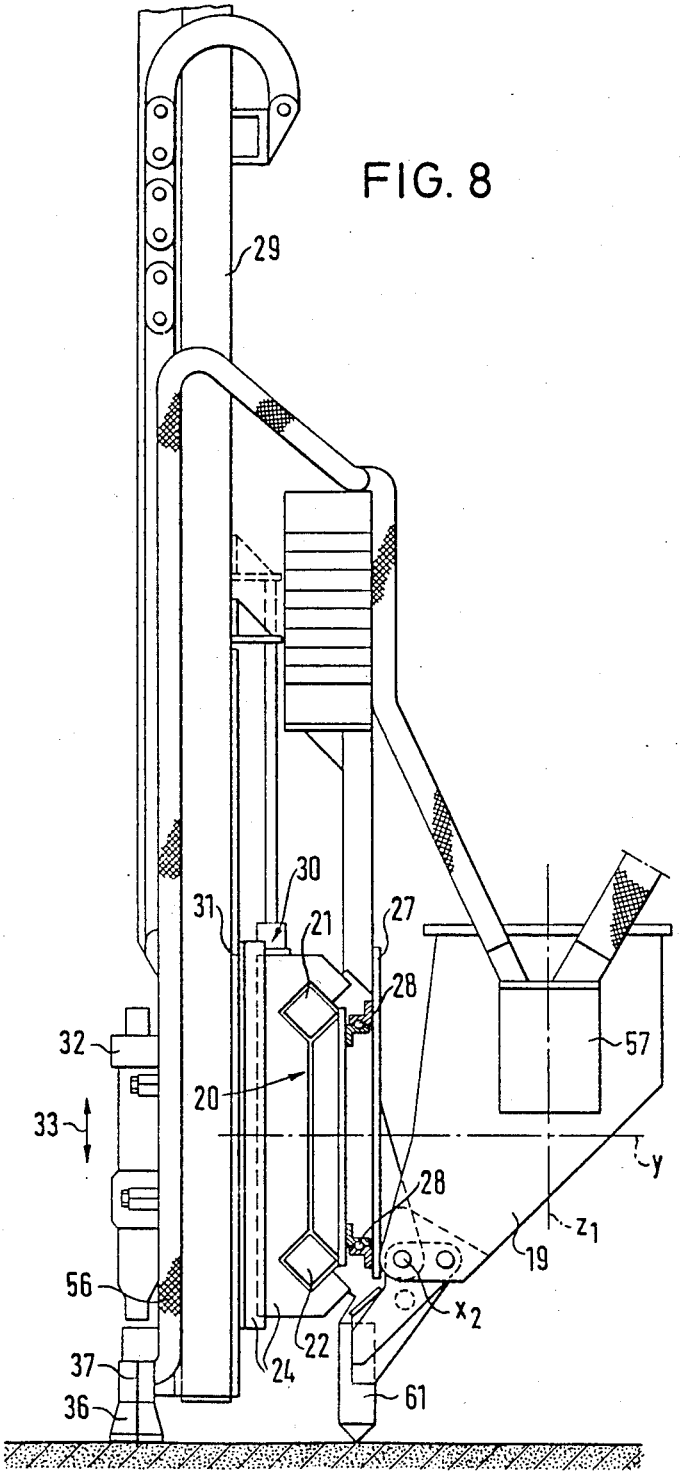
FIG. 8 is a side view of part of the drilling machine at an enlarged scale.

In the region beneath the pivot axis $x_2$ a support member 61 may also be provided about which the drilling unit 3 including the crossmember 20, the cradle 29 and the bracket 19 can be tilted while at the same time the suction skirt 36 is positioned in such a way that it is supported on the ground and its center axis and thus the drill rod 4 extend at a predetermined drilling angle of normally about 90° relative to the ground or rock surface (see FIG. 8). The support member 61 is configured as a support extending from the bracket 19 in the drilling direction, and the free end of the support is pointed or has at least wedge-like or knife-like design.

All of the features disclosed in the present papers are claimed as being essential to the invention to the extent to which they are novel over the prior art either individually or in combination.

I claim:

1. A machine for working rock comprising:

a supporting means being capable of rotating about a first axis which is approximately normal to the ground and a second axis which is approximately parallel to the ground;

a crossmember mounted to said supporting means;

a cradle mounted on said cross member to be reciprocally movable along said crossmember and approximately normal to said crossmember; and a drilling unit connected to the reciprocally movable along said cradle, said drilling unit being connected to said supporting means via said cradle and said crossmember in such a manner so as to be rotatable, relative to said supporting means, about three axes which are respectively normal to one another.

2. The machine as set forth in claim 1 further comprising an underframe defining a plane which is substantially parallel to the ground and a body mounted on said underframe, the supporting means comprising a boom having proximal and distal ends, said boom being pivotably attached to the body at its proximal end to be rotatable about a first pivot axis corresponding to said second axis, one degree of freedom of rotation of said boom being defined by the pivot axis of the boom on the body and another degree of freedom of rotation being defined by an upright swivel axis corresponding to said first axis and about which the body can be turned relative to th eunderframe.

3. The machine as claimed in claim 2 wherein there is provided on the distal end of the boom a connecting member for the drilling unit, said connecting member being pivotably attached to the distal end of said boom to be rotatable about a second pivot axis which extends approximately parallel to said first pivot axis.

4. The machine as claimed in claim 2, wherein the boom is composed of two boom arms, which are pivotably connected to one another via a connecting link axis which is parallel to said first pivot axis.

5. The machine as claimed in claim 1 characterized in that the cradle carrying the drilling unit is reciprocally movable, preferably by means of an hydraulic drive, relative to its connection with the boom of the excavator in the direction of the longitudinal extension of said cradle.

6. The machine as claimed in claim 1, characterized in that the drilling unit, which is movable along the cradle, is coupled to a chain which revolves about the two ends of the cradle and cooperates with a pinion of a drive motor wherein the pinion has a slotted disk associated therewith by which in conjunction with an optical or an electromagnetic sensor the motion of the pinion and thus of the drilling unit including the drilling tool along the cradle can be digitized and determined by the counting of pulses.

7. The machine as claimed in claim 1, characterized in that the cradle, which is reciprocally movable along the crossmember, is coupled to a chain which revolves about the two ends of the crossmember and which cooperates with a pinion of a drive motor, wherein the pinion has a slotted disk associated therewith by which in conjunction with an optical and/or an electromagnetic sensor the motions of the pinion and thus of the cradle along the crossmember can be digitalized and determined by the counting of pulses.

8. The machine as claimed in claim 1, characterized in that the boom linked to the body of the excavator is retained and pivotable in an upright plane by means of hydraulically, pneumatically or hydro-pneumatically controlled piston-cylinder units which are linked to the boom or the boom arms, on the one hand, and to the body of the excavator, on the other hand, and also the connecting plate linked to the distal end of the boom for connection thereto of the drilling unit or the crossmember carrying the drilling unit is retained and pivotable in an upright plane by means of an hydraulic, pneumatic or hydro-pneumatic piston-cylinder unit which is linked to the connecting plate, on the one hand, and to the boom or the outer boom arm, on the other hand, for correspondingly positioning the drilling unit or the drilling tool associated therewith relative to the drilled rock.

9. The machine as claimed in claim 8, characterized in that the cradle carrying the drilling unit is adapted to be supported on the surface of the drilled rock, wherein the pressure applied to the drilling tool and therefore to the drilled rock by the pistoncylinder units are associated with the boom and/or the connecting plate is controllable in dependence on the resistance such that the cradle will always remain in engagement with the rock surface.

10. The machine as claimed in claim 9, characterized in that the cradle is supported on the rock surface by way of a suction skirt through which the drilling tool passes while being radially supported.

11. The machine as claimed in claim 10, characterized in that the suction skirt is adapted to be opened, wherein the parting plane extends approximately through the geometrical center axis of the drilling tool.

12. The machine as claimed in claim 11, characterized in that the front half of the suction skirt, which is remote from the excavator is capable of being pivoted forwards together with the corresponding half of the drill rod mounting, whereby the drilling tool is released.

13. The machine as claimed in claim 11 characterized in that the suction skirt which can be opened cooperates with a locking means which comprises a locking strap in such a way that in the locked position the strap encloses and retains flanges of the two suction skirt halves, said flanges extending in parallel to the parting plane.

14. The machine as claimed in claim 13, characterized in that the locking strap is linked to the suction skirt half which is rigidly connected to the cradle such that the center of gravity of said strap is beneath the coupling point and the strap accordingly always moves in the closing direction due to its dead weight.

15. The machine as claimed in claim 10 characterized in that the suction skirt has a hose fitted thereto which is connected to a suction and filter unit mounted on the body of the excavator.

16. The machine as claimed in claim 15, characterized in that between suction skirt and suction and filter unit there is provided an impact-type separator for separating large-sized drillings.

17. The machine as claimed in claim 10 characterized in that the suction skirt and optionally also the impact-type separator each have an ultrasonic generator associated therewith by means of which drillings, especially moist dust adhering to the inside of the suction skirt or the impact-type separator and near the hose fitting areas can be removed by being cracked off.

18. The machine especially as claimed in claim 10 characterized in that the suction skirt is connected to a jacket made of flexible and especially sound-insulating material, said jacket extending from the suction skirt to the casing of a drilling hammer associated with the drilling tool and enclosing the drilling tool and optionally also the casing of the drilling hammer.

19. The machine as claimed in claim 10 characterized in that the suction skirt is formed with openings at defined locations for (optionally additional) intake of air.

20. The machine as claimed in claim 19, characterized in that the air intake openings are provided diametrically to the center axis of the suction skirt, especially in opposed relationship.

21. The machine as claimed in claim 19, characterized in that the air inlet openings are dimensioned in such a way that together with the volume of air contained inside the suction skirt they form Helmholtz resonators.

22. The machine as claimed in claim 19 characterized in that the air intake openings are provided at such an inclination in the same direction relative to the center axis of the suction skirt that a helical flow of air results inside the suction skirt.

23. The machine as claimed in claim 10, characterized in that the suction skirt is provided with circumferentially extending concavities and the air intake openings are provided in the region of said concavities.

24. The machine as claimed in claim 1, characterized in that an oscillation or pulsating motion can be superposed on a continuous rotary motion of the drilling tool so that the drilling tool rotates in pulsating fashion.

* * * * *